US007334954B1

(12) United States Patent
Rentz

(10) Patent No.: US 7,334,954 B1
(45) Date of Patent: Feb. 26, 2008

(54) RETRACTABLE FELT TIP PEN WITH AIR SEAL SYSTEM

(76) Inventor: Ceylon H. Rentz, 11894 Brady Rd., Jacksonville, FL (US) 32223-0759

( * ) Notice: Subject to any disclaimer, the term of this patent is extended or adjusted under 35 U.S.C. 154(b) by 0 days.

(21) Appl. No.: 11/673,141

(22) Filed: Feb. 9, 2007

Related U.S. Application Data

(63) Continuation-in-part of application No. 11/622,155, filed on Jan. 11, 2007.

(51) Int. Cl.
*B43K 5/00* (2006.01)

(52) U.S. Cl. ..... 401/202; 401/107

(58) Field of Classification Search ..... 401/29, 401/30, 32, 33, 99, 107, 108, 202
See application file for complete search history.

(56) References Cited

U.S. PATENT DOCUMENTS 3,525,573 A * 8/1970 Fend ..... 401/108
3,985,455 A * 10/1976 Wahlberg ..... 401/30
4,469,462 A * 9/1984 Hashimoto et al. ..... 401/107
6,340,260 B1 * 1/2002 Dao ..... 401/202

* cited by examiner

*Primary Examiner*—Huyen Le
(74) *Attorney, Agent, or Firm*—Jonathan Rigdon Smith, P.C.; Jonathan R. Smith

(57) ABSTRACT

A retractable felt tip pen has a seal system that prevents air from drying out the felt between uses. The seal system can be actuated with one hand, and comprises two sealing devices that may be used in series in the pen or may be used alone. The first sealing device is a flexible self-sealing membrane, and the second is a specially-shaped and hinged cap. The membrane is actuated by extension and retraction of the felt itself. The cap may be actuated either by extension of the felt alone or by the push of a finger on the cap. Replacement of the cap is effected by snapping the cap over the end of the pen, again with one finger.

7 Claims, 9 Drawing Sheets

RETRACTABLE FELT TIP PEN WITH AIR SEAL SYSTEM

CLAIM OF PRIORITY

This patent application is a Continuation-in-Part of application Ser. No. 11/622,155 filed Jan. 11, 2007.

FIELD OF INVENTION

This invention is in the field of hand-held writing instruments, more specifically those designed for carrying in a pocket, and more specifically those designed for operation with one hand.

BACKGROUND OF INVENTION

The invention of the felt-tip pen in the late $20^{th}$ century greatly expanded the versatility of the ink pen by providing a wider line. This greater width made it possible to hand write large characters that could be seen from a greater distance. It also enabled calligraphic writing capability with less attention to ink spillage, as would normally be the case when dipping a fountain pen nib in a bottle of ink, and with better control the application of ink to medium than can be had with a brush. The large ink capacity of felt wicks provided an alternative to the ball point as a disposable pen. The highlighter pen is an extension of the felt tip pen using high transmittance inks.

The chief drawback to felt tip pens is that they dry out quickly if left uncapped. This means that people who would like to utilize the full life of a felt tip pen or highlighter must take care to replace the cap after each use and even during idle periods while using the device. This makes using such a device a two-handed (or one hand plus teeth) operation. A need exists for a means, either self actuating or operable with one hand, to prevent the ink from drying out.

BRIEF DESCRIPTION OF INVENTION

This invention is a felt tip pen having a retractable tip and a system for sealing the tip against the free flow of ambient air. The air seal system can be actuated with one hand. The air seal system comprises two sealing devices that may be used in series in the pen or may be used alone as separate embodiments. The first sealing device is a flexible self-sealing membrane, and the second is a specially-shaped and hinged cap. The membrane is actuated by extension and retraction of the felt itself. The cap may be actuated either by extension of the felt alone or by the push of a finger. Replacement of the cap is effected by snapping the cap over the end of the pen, again with one finger. A third embodiment provides a resilient foam gasket to further reduce possible air intrusion through the first embodiment. A fourth embodiment is a felt tip pen having two felt tips, one at either end, in combination with one or more of the first three embodiments' air seal system.

The principal object of the invention is, then, to providing a felt tip pen having one or two felt tips, the felt tips being provided with means for extending and retracting them from inside a case and being provided with means for sealing them during non-use against drying out by exposure to the ambient air. Another object of the invention is to provide such means for extending and means for sealing as are operable with one hand while holding the pen.

DETAILED DESCRIPTION OF INVENTION

Figure 1:
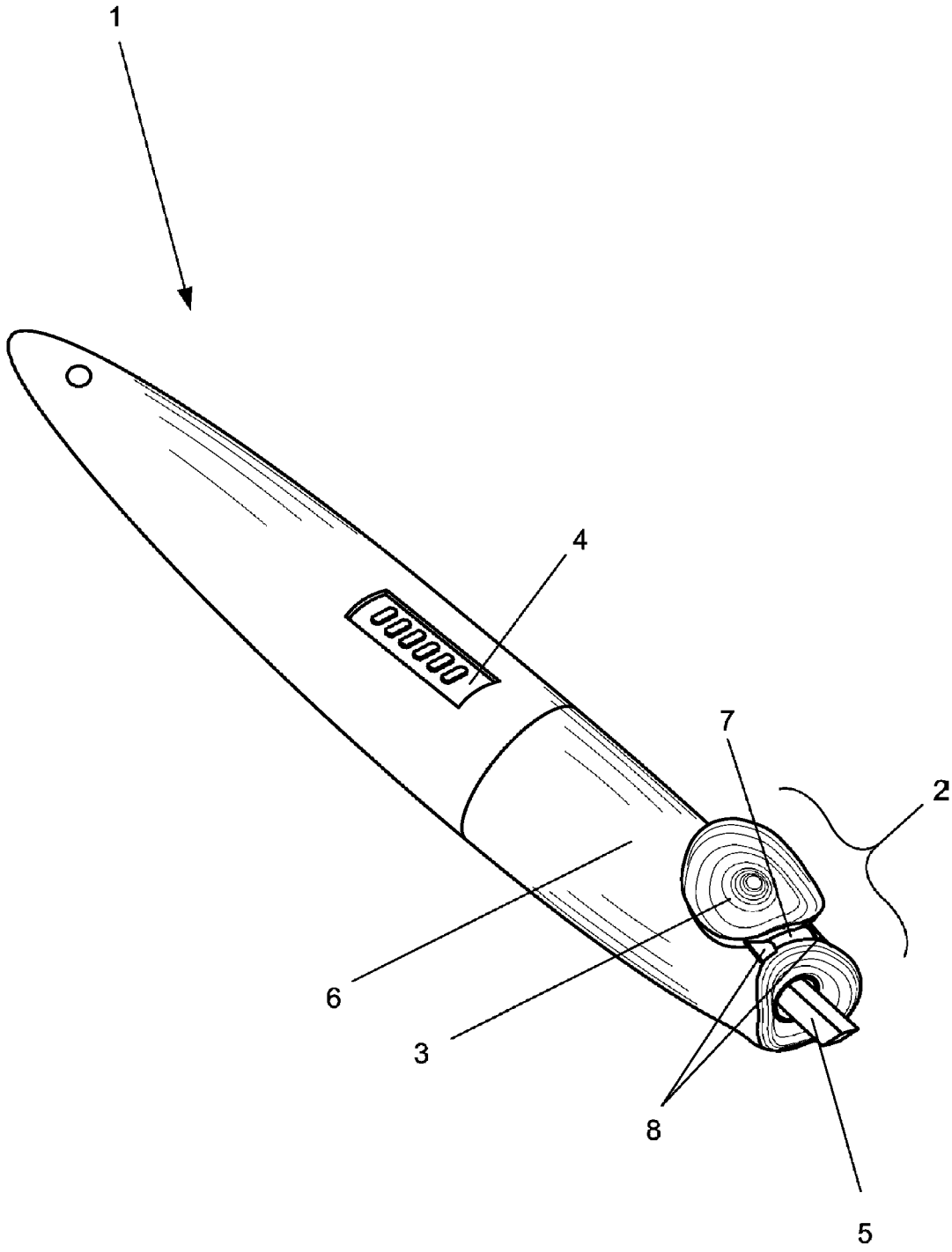
FIG. 1 is a perspective view of the first embodiment of the invention in the open position.

Referring now to the drawings, in which like elements in each drawing are represented by like reference numerals, FIG. 1 is a perspective view of the first embodiment of the invention, a retractable felt tip pen 1 with an air seal system 2 comprising a cap 3. In this and all of the following drawings, a highlighter-type of pen is depicted as the pen on which the air seal system 2 is installed, but the air seal system 2 is meant to apply to any pen utilizing ink that will dry on the tip at a speed rendering the pen unusable within a few hours or less unless the tip is enclosed against the free flow of air. This highlighter 1 is equipped with extending and retracting means 4 for extending and retracting a felt tip 5 from within the barrel 6 of the highlighter 1. The details of embodiments comprising extending and retracting means 4 are provided in application Ser. No. 11/622,155 by reference, to which this application is a Continuation-in-Part. The highlighter 1 is shown here with the air seal system 2 in the open position and felt tip 5 extended. Cap 3 attached to one side 7 of the barrel 6 by means of spring hinges 8.

Figure 2:
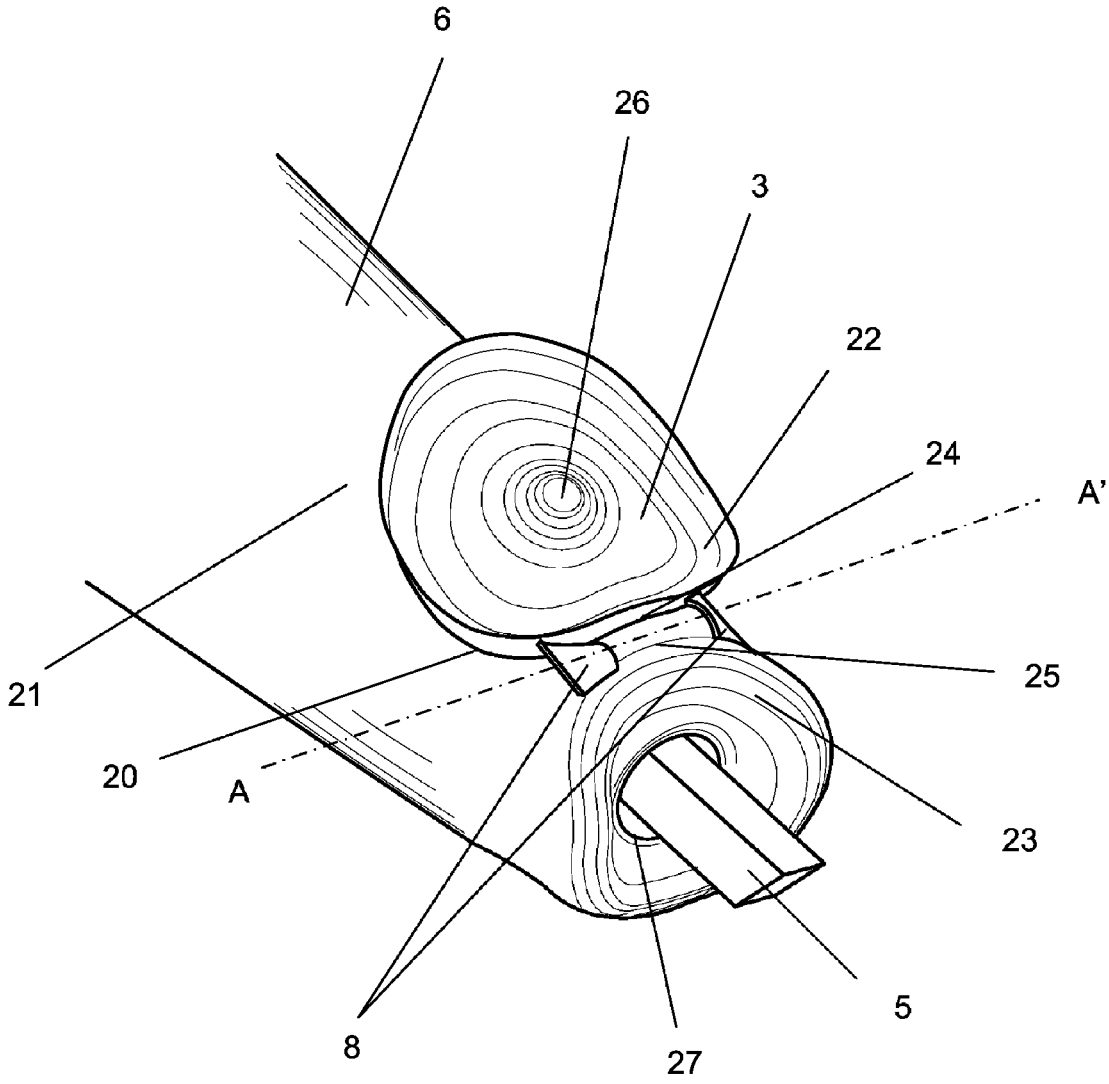
FIG. 2 is a perspective close-up view of the first embodiment in the open position.

FIG. 2 is a perspective close-up view of the first embodiment in the open position. Cap 3 is saddle-shaped so that its outer surface 20 conforms substantially to the cylindrical surface 21 of barrel 6, while at the same time, its inner surface 22 fits the rounded nose 23 of the pen barrel 6. Spring hinges 8 are molded integrally into proximal edge 24 of cap 3 and into upper edge 25 of nose 23, so that when cap 3 is fully open (lying against barrel 6) hinges 8 are in their least biased state. Two hinges 8 are shown here, but the number of hinges is not important so long as the hinges (or hinge) force cap 3 to rotate in a replicable manner about axis A-A'.

Note that cap 3 has molded into it a button 26 shaped to fit within recess 27 in nose 23. This permits felt tip 5 to push cap 3 open when it is extended.

Figure 3:
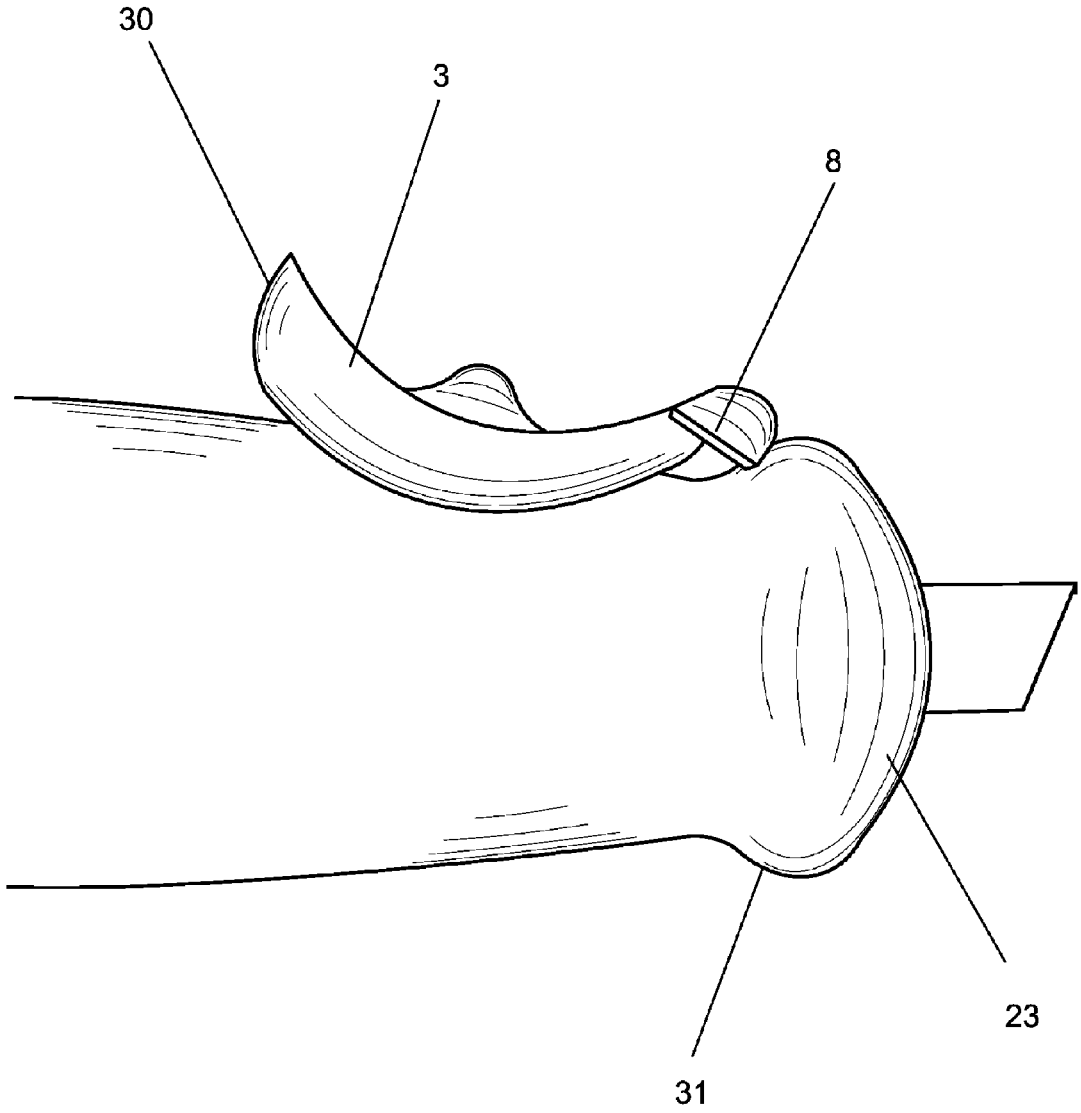
FIG. 3 is a side close-up view of the first embodiment in the open position.

FIG. 3 is a side close-up view of the first embodiment in the open position. This view illustrates how distal edge 30 of cap 3 is shaped to engage bottom edge 31 of nose 23, holding cap 3 closed over nose 23 against biasing force of hinge 8.

Figure 4:
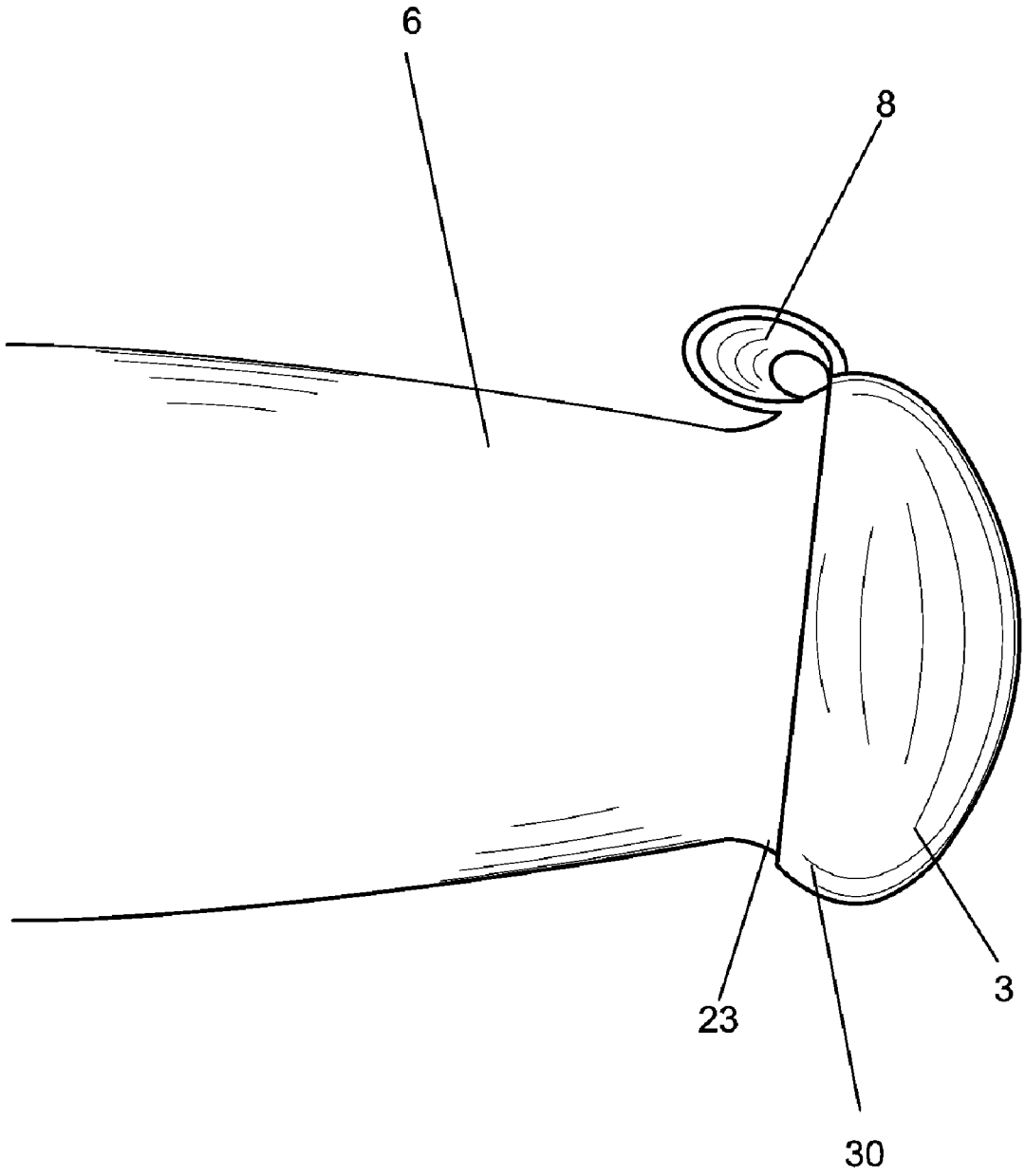
FIG. 4 is a side close-up view of the first embodiment in the closed position.

FIG. 4 is a side close-up view of the first embodiment in the closed position. Note that hinge 8 is flexed, but cap 3 is held in place by having its distal edge 30 being snapped in place over nose 23. Because hinge 8 is maximally biased in this figure and minimally biased when fully open (FIG. 2), if cap 3 is dislodged either by finger pressure against distal edge 30 of cap 3 or by pressure of the felt tip (hidden in this view) against the inside of cap 3, cap 3 will spring fully open and rest against barrel 6.

Hinge or hinges 8 may be reinforced to increase biasing tendency by the embedment of stiffening elements inside them, such as wires (not shown) when the apparatus is molded.

Figure 5:
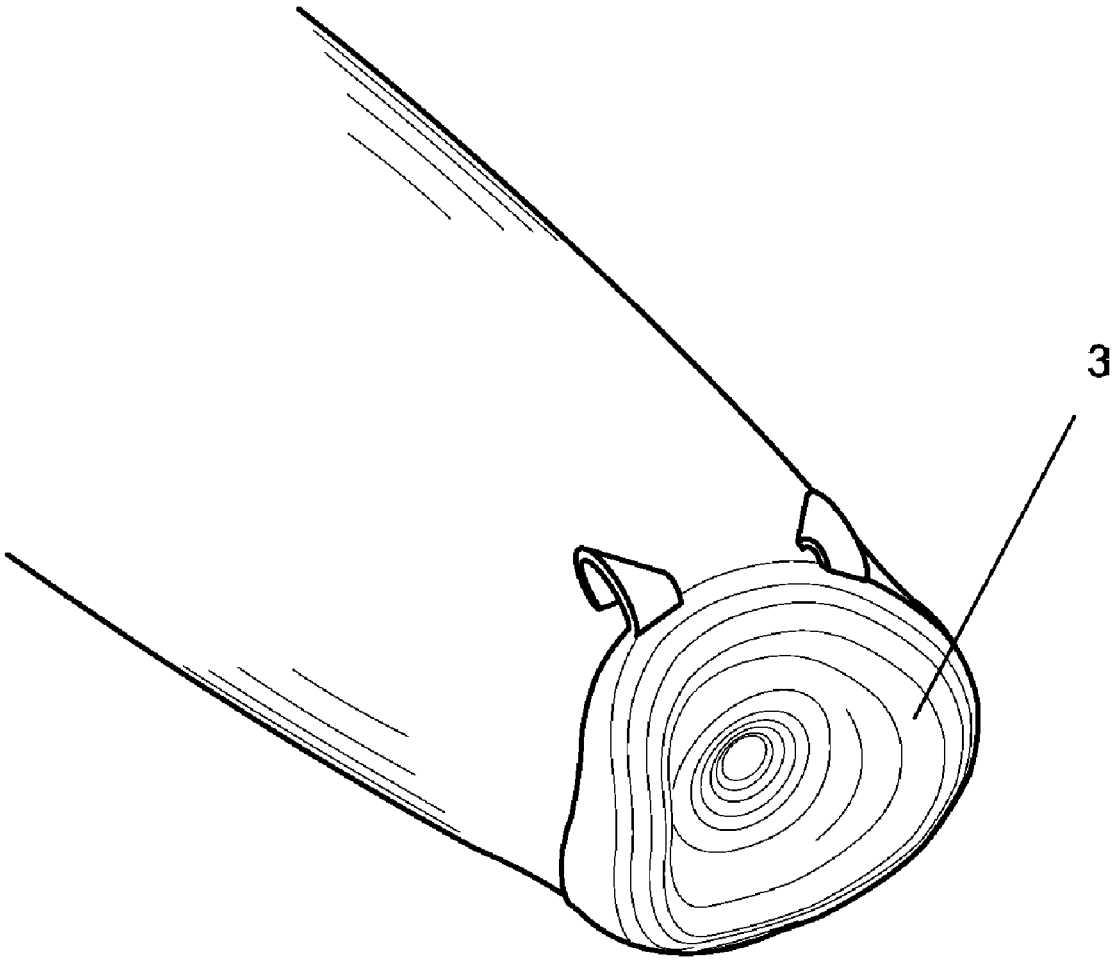
FIG. 5 is a perspective close-up view of the first embodiment in the closed position.

FIG. 5 is a perspective close-up view of the first embodiment in the closed position. Note that cap 3, shaped to fit nose 23 (hidden under the cap) presents a rounded end that will be resistant to snagging on clothing or the inside of a container.

Figure 6:
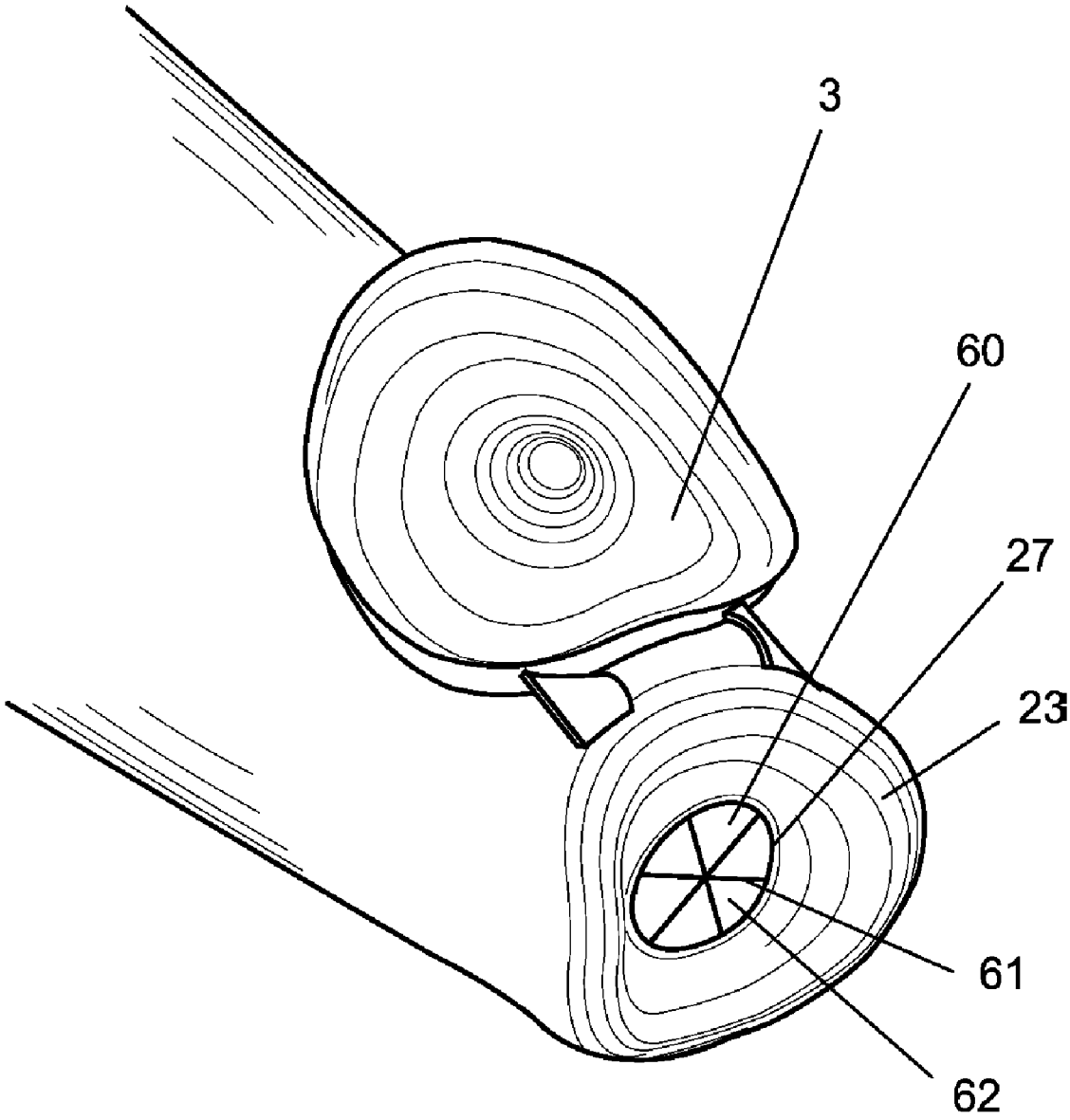
FIG. 6 is a perspective close-up view of the second embodiment in the closed position.

FIG. 6 is a perspective close-up view of the second embodiment in the closed position. It shows a perforated membrane closure 60 molded into recess 27 in nose 23. The membrane closure 60 is perforated by a plurality of slits 61 which divide the closure into a plurality of flaps 62. Membrane closure 60 may be provided by itself, or it may be provided, as shown here, in combination with the cap 3 provided in the first embodiment.

Figure 7:
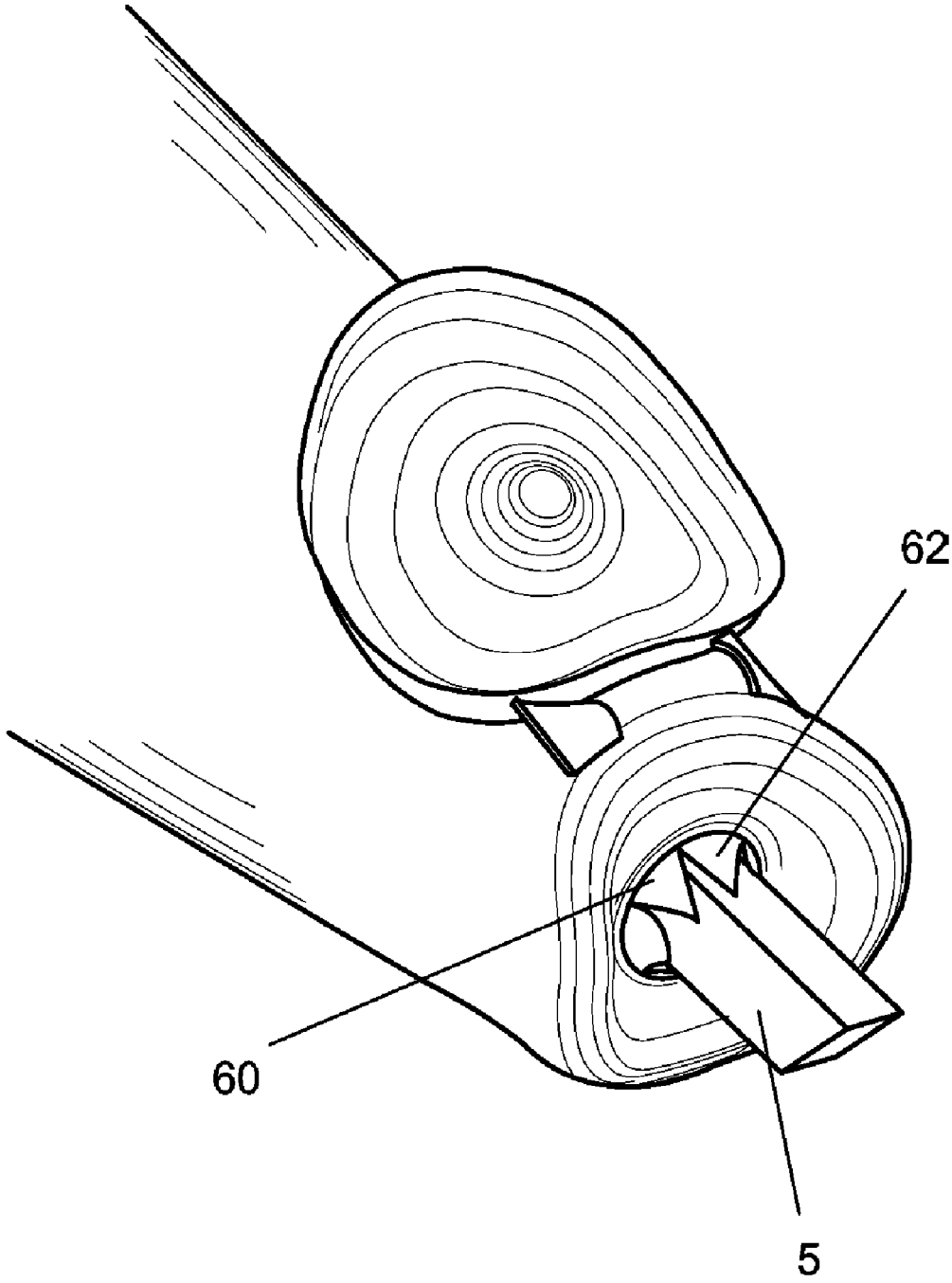
FIG. 7 is a perspective close-up view of the second embodiment in the open position.

FIG. 7 is a perspective close-up view of the second embodiment in the open position. Note that the felt tip 5 penetrates and opens the flaps 62 of the perforated membrane closure 60 when it is extended.

Figure 8:
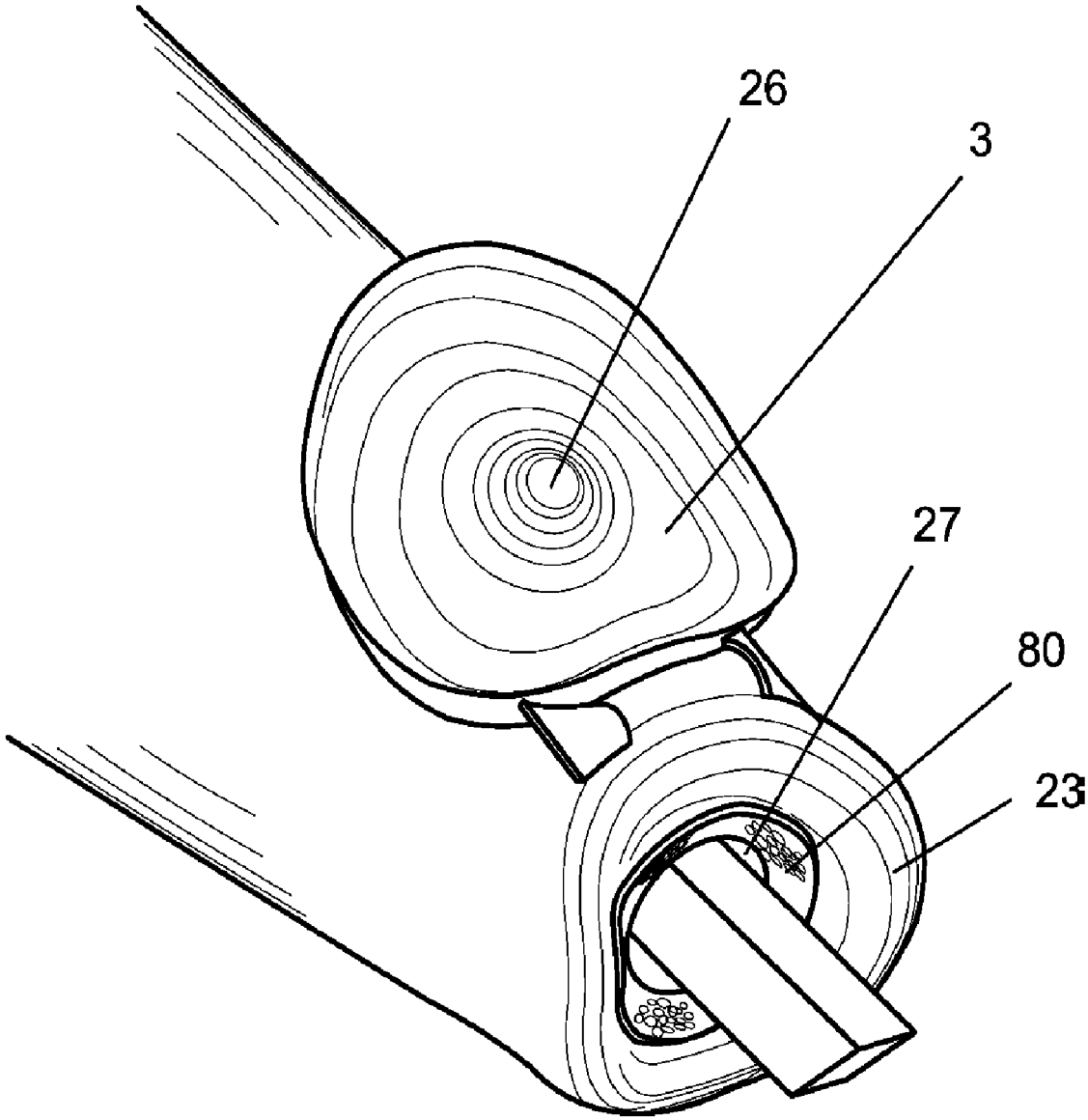
FIG. 8 is a perspective close-up view of the third embodiment in the open position.

FIG. 8 is a perspective close-up view of the third embodiment in the open position. This embodiment is a modification of the first embodiment in which a resilient seal 80 is fixed to nose 23 about recess 27 to provide additional protection against evaporation of ink when cap 3 is closed over nose 23. Optionally, this seal may be applied instead to the inside of the cap 3 surrounding button 26. The third embodiment therefore amounts to the addition of seal 80 to the first or second embodiments.

Thus, this invention can take the form of the first embodiment (cap only), the second embodiment (membrane only or membrane combined with cap), or the third embodiment (cap with seal, with or without membrane).

Figure 9:
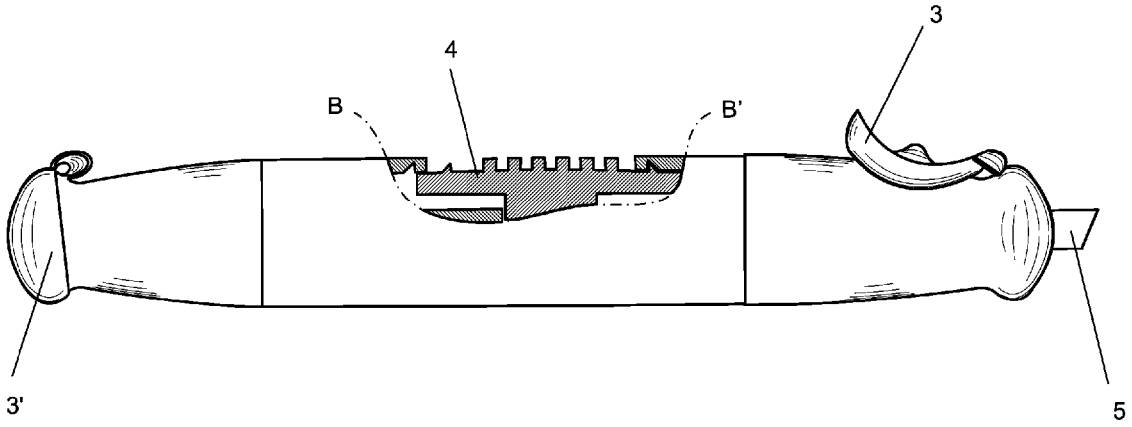
FIG. 9 is a side view of the fourth embodiment of the invention.

FIG. 9 is a side view of the fourth embodiment of the invention. The fourth embodiment provides a felt tip 5 at one end, and a second felt tip at the other end, hidden from view by second cap 3'. These tips may be impregnated with inks having different properties, such as color. Both ends are equipped either the caps of the first embodiment, as shown here with the right one (cap 3) in the open position, or with the combined features described as the second or third embodiments of the invention. In this embodiment, the extending and retracting means 4, shown in cutaway B-B', is constructed so that when it is pushed fully to the right, as shown here, felt tip 5 is extended and the second felt tip (not visible) is retracted. When it is pushed fully to the left, the felt tip now hidden extends, pushing open left cap 3', and felt tip 5 is retracted. Right cap 3 may be closed with one finger while holding the pen. When extending and retracting means is substantially equidistant between these two positions, neither tip is extended. More detail of the operation of extending and retracting means 4 is incorporated into this application from application Ser. No. 11/622,155 by reference.

What is claimed is:

1. A felt tip pen, comprising:

an elongate, hollow case having a substantially linear elongate axis, the case further comprising two opposing ends;

a hole in at least one end;

at least one felt tip extendable and retractable from the at least one end;

means for extending and retracting the at least one felt tip with a finger tip;

a shaped cap fitting over a congruently-shaped nose molded onto said at least one end integrally to said case, with said hole centered on the shaped nose, said hole being substantially perpendicular to and coaxial with said axis;

the shaped nose shaped according to planar geometric elements having curved peripheries, the planes of the elements being substantially perpendicular to said axis;

the elements beginning at said hole and progressing along said axis away from said hole toward said opposing end, and having a progression of average diameters at first enlarging and then decreasing until the nose merges into said case;

the cap being integrally hinged to one side of the nose with at least one flexible hinge and snapping over the enlarged average diameters of the elements of the nose.

2. The felt tip pen of claim 1, in which:

said cap is attached to said at least one hinge, and said at least one hinge is attached to said one side of said nose, so that when said at least one hinge is in its most unbiased state, said cap is fully open and rests substantially alongside said case.

3. The felt tip pen of claim 2, in which:

said cap further comprises on its inner surface a button, substantially centered on said hole and extending far enough into said case such that when said at least one felt tip is extended, said felt tip pushes on the button, unsnapping said cap.

4. The felt tip pen of claim 3, in which:

the outer surface of said cap is shaped to conform to the outer surface of said case when said cap is fully open.

5. The felt tip pen of claim 4, in which:

the outer surface of said case comprises means for releasably holding said cap against the outer surface of said case.

6. The felt tip pen of claim 5, in which:

the annular surface of contact between said nose and said cap surrounding said hole further comprises means for sealing said nose against said cap.

7. The felt tip pen of claim 6, in which:

said means for sealing said nose against said cap comprises a piece of resilient foam.

* * * * *